US009420937B2

(12) United States Patent
Deweerd et al.

(10) Patent No.: US 9,420,937 B2
(45) Date of Patent: Aug. 23, 2016

(54) DISHWASHER WITH DYNAMICALLY CONTROLLED CYCLE OF OPERATION

(75) Inventors: Brent A. Deweerd, Saint Joseph, MI (US); Brooke L. Lau, Saint Joseph, MI (US); Robert J. Pinkowski, Baroda, MI (US); Robert J. Rolek, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1722 days.

(21) Appl. No.: 12/640,689

(22) Filed: Dec. 17, 2009

(65) Prior Publication Data

US 2011/0146716 A1 Jun. 23, 2011

(51) Int. Cl.

*A47L 15/46* (2006.01)
*A47L 15/42* (2006.01)
*A47L 15/00* (2006.01)

(52) U.S. Cl.

CPC ..... *A47L 15/4229* (2013.01); *A47L 15/0026* (2013.01); *A47L 15/0028* (2013.01); *A47L 15/0034* (2013.01); *A47L 15/0057* (2013.01); *A47L 2401/023* (2013.01); *A47L 2401/10* (2013.01); *A47L 2501/11* (2013.01); *A47L 2501/30* (2013.01); *A47L 2501/34* (2013.01)

(58) Field of Classification Search

CPC ..... A47L 15/4229; A47L 15/4297; A47L 15/0057; A47L 15/0026; A47L 15/0028; A47L 15/0034; A47L 2401/10; A47L 2401/23; A47L 2501/11; A47L 2501/30; A47L 2501/34; D06F 39/004

USPC ..... 134/18, 25.2, 58 D

See application file for complete search history.

(56) References Cited

U.S. PATENT DOCUMENTS

| | | | | |
|---|---|---|---|---|
| 5,800,628 | A * | 9/1998 | Erickson et al. | 134/18 |
| 6,035,471 | A * | 3/2000 | Lahrmann et al. | 8/158 |
| 6,766,812 | B1 | 7/2004 | Gadini | |
| 7,162,896 | B2 | 1/2007 | Eiermann et al. | |
| 7,175,715 | B2 | 2/2007 | Eiermann | |
| 2002/0066873 | A1 * | 6/2002 | Poisel | A47L 15/4295 250/493.1 |
| 2002/0096192 | A1 * | 7/2002 | Reichold | A47L 15/0057 134/18 |
| 2004/0000320 | A1 * | 1/2004 | Eiermann | A47L 15/4229 134/1 |
| 2004/0009882 | A1 * | 1/2004 | Elsik et al. | 510/108 |
| 2005/0046826 | A1 * | 3/2005 | Eiermann | A47L 15/4229 356/133 |

FOREIGN PATENT DOCUMENTS

| | | | |
|---|---|---|---|
| DE | 4041108 | A1 | 6/1992 |
| DE | 19638514 | A1 | 3/1998 |
| DE | 19721976 | A1 | 12/1998 |
| DE | 19825981 | A1 * | 12/1999 |
| EP | 0517205 | A1 | 12/1992 |
| EP | 0966914 | A2 | 12/1999 |
| EP | 1865100 | A1 | 12/2007 |
| KR | 20040006281 | A | 1/2004 |
| WO | 03/020645 | A2 | 3/2003 |

* cited by examiner

*Primary Examiner* — Michael Kornakov
*Assistant Examiner* — Katelyn Whatley

(57) ABSTRACT

A method of controlling the operation of an automatic dishwasher having at least one cycle of operation and a sensor that indicates a degree of turbidity of liquid in the dishwasher includes repeatedly determining a correction value for the sensor related to the scaling of the sensor and executing a de-scaling cycle of operation based thereon.

5 Claims, 3 Drawing Sheets

DISHWASHER WITH DYNAMICALLY CONTROLLED CYCLE OF OPERATION

BACKGROUND OF THE INVENTION

Contemporary automatic dishwashers for use in a typical household include a tub and an upper and lower rack or basket for supporting soiled utensils within the tub. A spray system and a filter system are provided for re-circulating wash liquid throughout the tub to remove soils from the dishes. Some conventional dishwashers have a turbidity sensor to measure turbidity of a wash liquid. The turbidity can be viewed as a measurement of the "dirtiness" of the wash liquid, due to the presence of suspended particulate matter. The turbidity level indicates the amount of food soil that has been removed from the dishes and enables the dishwasher to determine if the re-circulating wash liquid is appropriate.

These types of sensors are affected by conditions such as buildup on the optical surfaces, light source output drift, and photodiode sensitivity drift. Compensation techniques can be used to lessen the effect of buildup on the optical surfaces, so that the turbidity measuring can be continued even if there is buildup on the optical surfaces of the turbidity sensor. There is a limit to these compensation techniques, as the turbidity sensor can get too dirty to generate reliable data. In this case, the sensor is turned off and the dishwasher switches to a default setting that does not use the turbidity measurements.

BRIEF DESCRIPTION OF THE INVENTION

The invention relates to dynamically controlling an automatic dishwasher having a sensor that indicates a degree of turbidity of liquid in the dishwasher.

DESCRIPTION OF AN EMBODIMENT OF THE INVENTION

Figure 1:
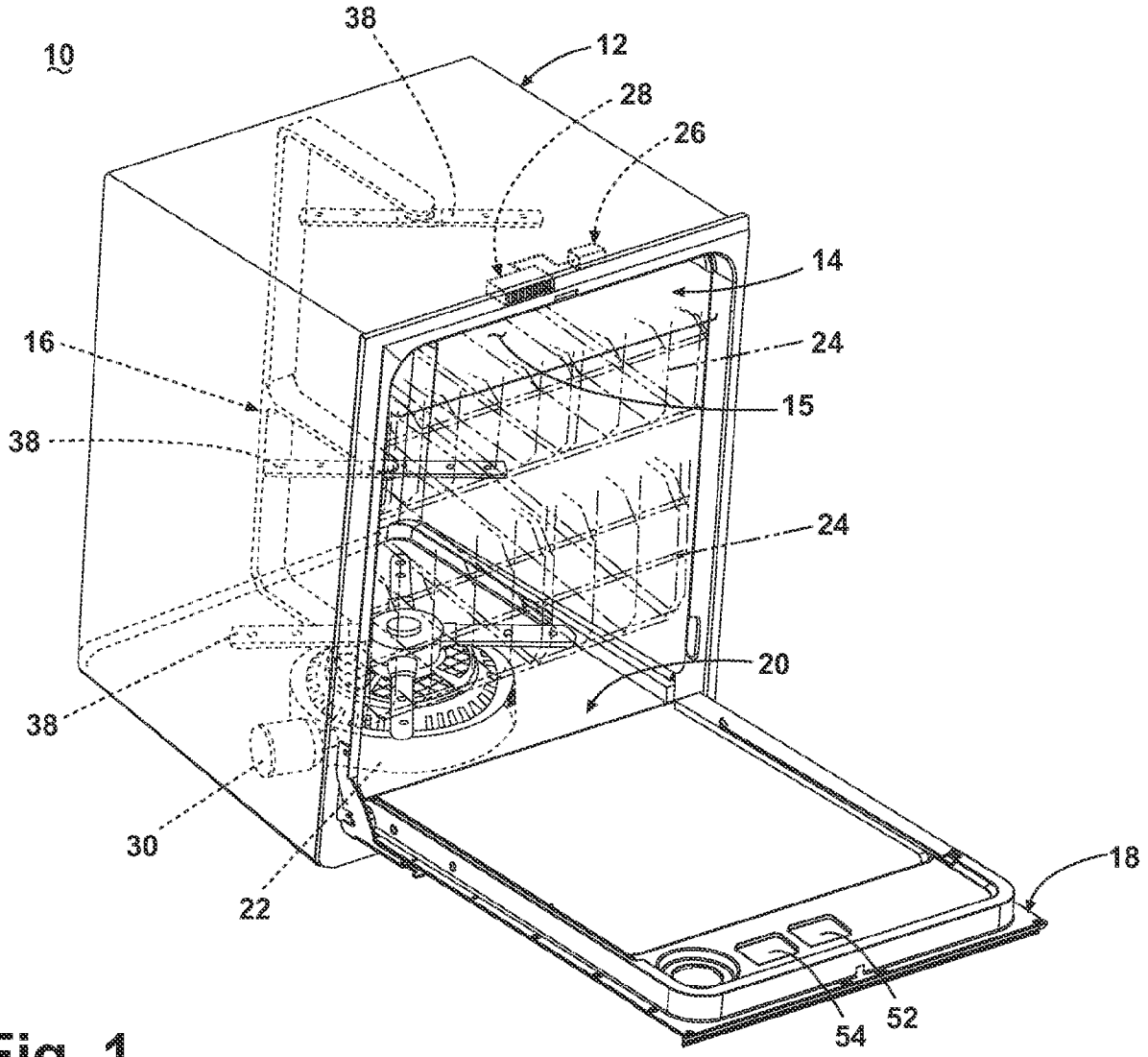
FIG. 1 is a perspective view of a dishwasher in accordance with a first embodiment of the invention.

Referring now to the drawings, wherein like numerals indicate like elements throughout the views, FIG. 1 illustrates an automatic dishwasher 10 according to a first embodiment of the invention. The dishwasher 10, which shares many features of a conventional automated dishwasher that will not be described in detail herein except as necessary for a complete understanding of the invention. The dishwasher 10 has an open face cabinet 12 enclosing a washtub 14 defining a wash chamber 15 with a liquid system 16 for spraying and draining liquid from the washtub 14. A closure element is provided for selectively closing the open face of the washtub 14 and is illustrated as a door 18, which may be pivotally attached to the dishwasher 10 for providing accessibility to the wash chamber 15 for loading and unloading utensils or other washable items. As used in this document, the term utensils is meant to be generic and cover any item, singular or plural, that may be washed in a dishwasher, including, without limitation: silverware, dishes, plates, bowls, glassware, pots, and pans.

The washtub 14 has a bottom wall 20 with a sump 22 formed therein. While the sump 22 is illustrated as a well, the sump 22 may be of any size or shape and is generally the lowest portion of the washtub 14 where the liquid naturally collects and can be drained. One or more dish racks 24 may be provide in the washtub 14. A control unit 26 and a user interface 28 may be located in the cabinet 12 or in the door 18. The control unit 26 is operably coupled to the various components of the dishwasher 10 and controls their operation according to one or more cycles of operation.

A detergent dispenser 52 and a rinse aid dispenser 54 may be located in the door 18 or virtually anywhere within the dishwasher 10. It will be understood that depending on the type of dishwasher and the type of detergent used, the detergent dispenser 52 and the rinse aid dispenser 54 may be incorporated into one dispensing mechanism. Either dispenser can be of a single use dispenser type or a bulk dispenser type. In the case of bulk dispensing, the detergent and/or rinse aid can be selectively dispensed into the wash chamber 15 in a regulated quantity and at a predetermined time or multiple times during one cycle of operation.

A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

Figure 2:
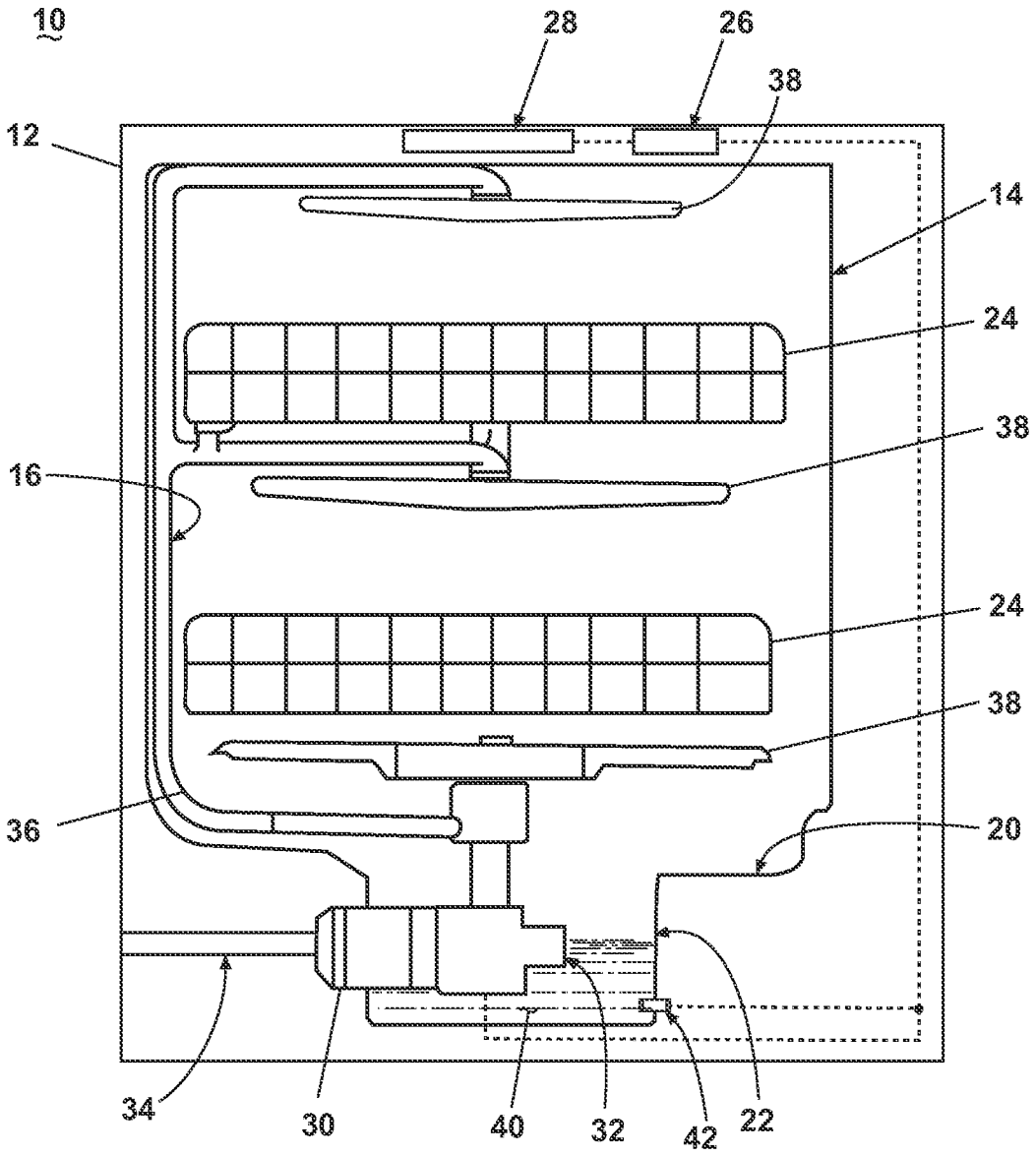
FIG. 2 is a schematic, cross-sectional view of the dishwasher shown in FIG. 1.

Referring now to FIG. 2, the liquid system 16 is schematically illustrated in greater detail. The liquid system 16 comprises a pump 30 located in the sump 22. The pump 30 has a pump inlet 32 fluidly coupled to the sump 22 to draw in liquid 40 at the bottom of the washtub 14. The pump 30 is fluidly coupled to a drain line 34 and a circulation line 36, which supplies liquid to one or more sprayers 38. Liquid drawn into the pump inlet 32 may be directed to either the drain line 34 or to the circulation line 36.

As illustrated, the pump 30 is a single pump, which may be operated to supply to either the drain line 34 or circulation line 36, such as by rotating in opposite directions or by valves. However, it is possible for the single pump 30 to be replaced by two pumps, with one of the two pumps supplying the circulation line 36 and the other of the two pumps supplying the drain line 34.

A sensor 42 may be located near the bottom wall 20 or in the sump 22. The sensor 42 is operably coupled to the control unit 26 such that an output from the sensor 42 is provided to the control unit 26, which may use the output to control the operation of the dishwasher 10. More specifically, the output from the sensor 42 may be a signal indicative of the degree of turbidity of the liquid within the dishwasher 10. The sensor 42 may be configured as either a flow through device or as an immersible probe. It will be understood, that the sensor 42 may be located virtually anywhere within the dishwasher 10 with at least one optical surface of the sensor 42 being in contact with the wash liquid 40. Any sensor capable of outputting the signal indicative of the degree of turbidity of the liquid in the dishwasher 10 may be used. Some non-limiting examples are: a turbidity sensor and an optical sensor of a transmissive, reflective and/or scattered type. Each of these sensors may generate different values/data and have different working ranges. An appropriate modification to an algorithm of the present invention may be required to accommodate for each different type of sensor. Additionally, the sensor 42 may be of a multifunctional type capable of foam, air and/or temperature detection(s).

Figure 3:
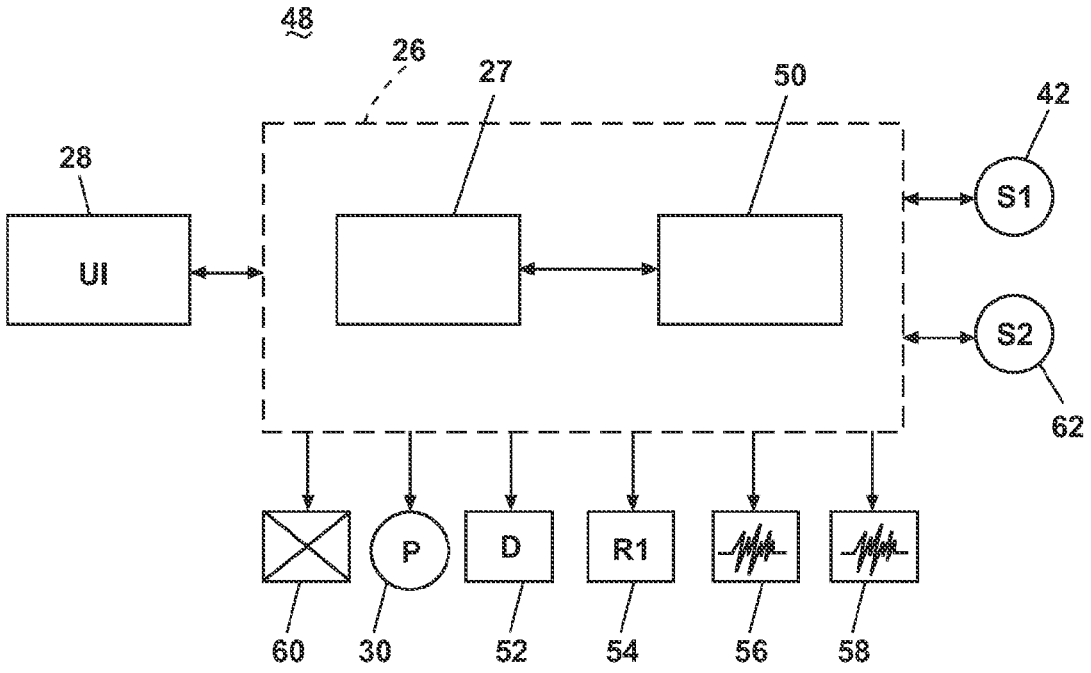
FIG. 3 is a schematic view of a control system in accordance with the embodiment shown in FIGS. 1 and 2.

Referring now to FIG. 3, which is a schematic view of a control system 48 according to the embodiment of FIGS. 1 and 2. The control unit 26 may be a microprocessor 27 having associated memory 50 in which various cycle algorithms and lookup tables may be stored. The control unit 26 may be operably coupled with multiple components of the dishwasher 10 for communicating with and controlling the operation of the multiple components to complete a cycle of operation. For example, the control unit 26 may be coupled with the detergent dispenser 52, the rinse aid dispenser 54, a heater 56 for heating the wash liquid during a cycle of operation, a heater 58 for heating the air during the heated drying step, a valve 60 for fresh water supply, and the pump 30 for circulation and drainage of the fluids. The heater 56 and the heater 58 may be incorporated into one heating element performing dual function. That is, it can be configured to heat the wash liquid or heat the drying air depending on the currently performing step of the cycle of operation.

The control unit 26 may also be coupled with the user interface 28 for receiving user-selected inputs and communicating information to the user. As previously described, the control unit 26 may also receive input from the sensor 42. The control unit may also receive inputs from one or more other optional sensors 62, which are known in the art and not shown for simplicity. Non-limiting examples of optional sensors 62 that may be communicably coupled with the control unit 26 include a temperature sensor, a moisture sensor, a door sensor, a detergent and rinse aid presence/type sensor(s).

During the operation of the dishwasher 10, food and other solids suspended in the wash liquid buildup on the optical surface of the sensor 42 contacting with the wash liquid to form scaling. The rate at which buildup accumulates on the optical surface of the sensor 42 and other surfaces of the dishwasher 10 depends not only on the "dirtiness" of the utensils to be washed, but also to a very large extent on the hardness of the fresh water that is used. An initial calibration for the water hardness may be performed at a user's house during either a first cycle performed by the dishwasher 10 or a special cycle performed by the dishwasher 10. The amount of buildup may accumulate over multiple uses of the dishwasher 10 and will affect the measurements taken by the sensor 42. For example, the translucency of the wash liquid measured by the sensor 42 may be proportional to the magnitude of the voltage of the output of the sensor 42. An increase of scaling on the sensor 42 correlates to an increase in the voltage output from the sensor 42. This results in an output that indicates less transparent wash liquid than is actually in the dishwasher 10.

A correction value that accounts for the buildup on the sensor 42 may be determined during a cycle of operation of the dishwasher 10. This correction value can take into account the attenuation of the sensor 42 measurements due to buildup. Measurements of the sensor 42 output can be used to determine the correction value needed to account for such attenuation. The correction value for the sensor 42 can be determined multiple times during each cycle, once every cycle, or once every predetermined number of cycles.

Determining a correction value may be achieved in a variety of ways. For example, an initial value may be determined for the sensor output before or during the initial commissioning of the appliance. This value may be stored in the memory 50. During each working cycle of the appliance, the attenuation of the sensor may be measured under ideal conditions wherein there are no inclusions in the water. That is, during a portion of the cycle where the washing liquid is clear and not clouded. A delta correction value may be determined by taking the difference between the measured attenuation and the initial sensor output value. This delta correction value may then be used to control a cycle of operation for the dishwasher 10. For example, if the determined delta correction value is small no changes in the cycle of operation are needed, if it is moderate some recalibration of the sensor may be needed, or if it is high a de-scaling operation may be needed.

Different types of correction values may be determined. For example, instead of the delta correction value being as described above, the delta correction value may alternatively be determined by adding the measured attenuation on to the initial value. A proportionality constant correction value may also be determined. Such a correction value may be determined by taking a ratio of the measured attenuation and the initial value. An appropriate modification may be made to the sensor 42 output or the cycle of operation for the dishwasher 10 to accommodate for each different type of correction value.

As the correction value may be repeatedly determined, a rate of change of the correction value may be determined. The determined correction value, rate of change of the correction value and/or number of cycles can be stored in the memory 50. The determination of the rate of change of the correction value may be done by comparing each determined correction value to a previously determined correction value over a predetermined number of cycles. The determination of the rate of change of the correction value may also be done by determining a moving average of a predetermined number of the determined correction values. In order to determine the moving average, a predetermined number of the most recent determined correction values may be added and divided by that predetermined number, with each newly determined correction value replacing the oldest determined correction value for subsequent calculations. Additionally, the determination of the rate of change of the correction value may be done by comparing the moving average to a previously determined threshold value over a predetermined number of cycles. The threshold value may be a predetermined value set by the dishwasher manufacturer, selected by a user via the user interface 28, or determined based on the initial calibration. Further, the determination of the rate of change of the correction value may be done by comparing the moving average a previously determined moving average.

Alternatively, the determination of the rate of change of the correction value may be done by comparing each determined correction value to a predetermined threshold value over a predetermined number of cycles. The threshold value may be a predetermined value set by the dishwasher manufacturer, selected by a user via the user interface 28, or determined based on the initial calibration.

Alternatively, or additionally water hardness may be determined based on the determined rate of change. For example, the water hardness may be determined from a table lookup of water hardness and rate of change.

Based on either the determined correction value or rate of change the control system 48 can modify at least one cycle of operation for the dishwasher 10. For example, the determined rate of change may be compared to a threshold value and if the determined rate of change satisfies the threshold value, then the control system 48 can modify at least one cycle of operation for the dishwasher 10. The modification of the at least one cycle of operation may be to eliminate a step of the cycle of operation, add a step to the cycle of operation, to alter a parameter of the cycle of operation, or combinations thereof.

Moreover, multiple steps and/or parameters may be added, eliminated or altered to modify the cycle of operations described below.

For example, if the at least one cycle of operation has a heated drying step than the modification of the at least one cycle of operation may be to eliminate the heated drying step. Alternatively, the modification of the at least one cycle of operation may be to alter a temperature parameter during the heated drying step by reducing the temperature to a desired level. For example, the desired level can be set as a half or any fraction of a full heating temperature or non-heating drying also known as an air only drying may be performed with the heater being de-energized during the drying. Furthermore, the modification of the at least one cycle of operation may be to alter a time parameter during the heated drying step. For example, the heated drying step may be operated at a reduced temperature level but for an increased amount of. The modification of an increased length of time may also be used for a non-heating drying step. Elimination of the heated drying or the use of a lower temperature during drying may decrease the rate of scaling inside the dishwasher 10. The decrease in scaling is especially true for cases where the heater is not fully submerged under the liquid in the dishwasher 10.

The amount or type of chemistry applied during the washing step rinsing is another parameter that may be altered. Performing at least one additional rinsing to a first rinsing is another example of modifying the at least one cycle of operation. The additional rinsing may optionally use a reduced amount of rinse fluid compared to the first rinsing. Alternatively, a reduced amount of rinse fluid may be used during any rinsing step including the first rinsing. Performing one or more additional rinses may also decrease the rate of scaling inside the dishwasher 10.

The dishwasher 10 may be capable to perform a special de-scaling cycle that removes the mineral deposits that have built-up inside the dishwasher 10. The de-scaling cycle may utilize special chemicals introduced to the liquid accessible parts of the dishwasher 10 and may be followed by at least one rinsing steps. Based on either the determined correction value or rate of change the control system the de-scaling cycle may be executed. For example, the correction value may be compared to a threshold value that indicates that the sensor 42 is too dirty and will not provide trusted data. Alternatively, the determined rate of change may be compared to a threshold value and the de-scaling cycle may be executed if the determined rate of change satisfies the threshold value. To satisfy the threshold value, the determined rate of change should be greater than, equal to or less than the threshold value as the case may be.

While the invention has been specifically described in connection with certain specific embodiments thereof, it is to be understood that this is by way of illustration and not of limitation. For example, while the present invention is described in terms of a conventional dishwashing unit as illustrated in FIG. 1 and FIG. 2, it can also be implemented in other types of dishwashing units such as in-sink dishwashers or drawer dishwashers. For both the in-sink and drawer-type dishwashers, the tub is oriented such that the open face is upward. The cabinet functions as the door for the drawer-type dishwasher, wherein the sliding of the drawer relative to the cabinet selectively closes the open face. Reasonable variation and modification are possible within the scope of the forgoing disclosure and drawings without departing from the spirit of the invention, which is defined in the appended claims.

What is claimed is:

1. A method of controlling operation of a dishwasher having at least one cycle of operation and a sensor outputting a signal indicative of a degree of turbidity of liquid within the dishwasher and where soils build up on the sensor to form scaling, the method comprising:

repeatedly determining a correction value for the sensor of the dishwasher related to scaling of the sensor where the sensor is in contact with wash liquid within a wash chamber or liquid system within a cabinet of the dishwasher;

determining a rate of change of the correction value based on the repeated determinations of the correction value; and executing a de-scaling cycle of operation of the dishwasher based on the determined rate of change of the correction value.

2. The method of claim 1, further comprising comparing the determined rate of change of the correction value to a threshold value and executing the de-scaling cycle of operation if the determined rate of change of the correction value satisfies the threshold value.

3. The method of claim 1, wherein determining the rate of change of the correction value comprises at least one of:

comparing each determined correction value to a predetermined threshold value over a predetermined number of cycles;

comparing each determined correction value to a previously determined correction value over a predetermined number of cycles;

determining a moving average of a predetermined number of the repeatedly determined correction values and comparing the moving average to a previously determined threshold value; or determining a moving average of a predetermined number of the determined correction values and comparing the moving average to a previously determined moving average.

4. The method of claim 1, further comprising determining water hardness based on the determined rate of change of the correction value.

5. The method of claim 4, wherein the water hardness is determined from a table lookup of water hardness and rate of change.

* * * * *